US009539850B2

(12) United States Patent
Enguita

(10) Patent No.: US 9,539,850 B2
(45) Date of Patent: Jan. 10, 2017

(54) ROLLABLE PAINT BUCKET

(71) Applicant: Steven Edward Enguita, Fort Myers, FL (US)

(72) Inventor: Steven Edward Enguita, Fort Myers, FL (US)

( * ) Notice: Subject to any disclaimer, the term of this patent is extended or adjusted under 35 U.S.C. 154(b) by 0 days.

(21) Appl. No.: 13/647,446

(22) Filed: Oct. 9, 2012

(65) Prior Publication Data

US 2014/0097586 A1 Apr. 10, 2014

(51) Int. Cl.
*B44D 3/12* (2006.01)

(52) U.S. Cl.
CPC ..... *B44D 3/12* (2013.01); *B44D 3/126* (2013.01)

(58) Field of Classification Search
CPC ..... B44D 3/00; B44D 3/04; B44D 3/126; B05C 21/00
USPC ..... 15/257.06
See application file for complete search history.

(56) References Cited

U.S. PATENT DOCUMENTS 4,908,904 A * 3/1990 Smith, Jr. ..... A47L 13/58 15/264
5,511,279 A * 4/1996 Ippolito ..... 15/257.06
7,424,959 B1 * 9/2008 Biebel ..... B44D 3/126 15/257.06
7,467,728 B2 * 12/2008 Lundy ..... B44D 3/12 220/505
2009/0302563 A1 * 12/2009 Thibault ..... 280/47.34

* cited by examiner

*Primary Examiner* — Allen Shriver
*Assistant Examiner* — Erez Gurari
(74) *Attorney, Agent, or Firm* — William E. Noonan

(57) ABSTRACT

A rollable paint bucket which will be maneuvered on a floor by the painter manipulating an extended handle of a paint roller assembly is disclosed. The bucket will have a body, a plurality of rolling members and a structural configuration which permits placement of the paint roller on the bucket where it will remain in contact during maneuvering of the bucket on the floor by the painter. The body has a paint containment area and a rolling surface. The painter may easily replenish fresh paint on the paint roller and roll the paint roller to obtain a desired quantity and uniformity of coverage on the paint roller. The bucket permits the painter to paint a large area, along a great distance, while remaining standing straight. This eliminates the conventional need for the painter to manually move their supply of fresh paint which often involves bending or squatting.

19 Claims, 7 Drawing Sheets

'PRIOR ART'

ROLLABLE PAINT BUCKET

RELATED PATENT APPLICATION

A Utility Patent application is being filed by the sole Inventor of this application on the same date as the filing of this application and having a title of: "INSERT FOR A PAINT BUCKET".

BACKGROUND

1. Field of the Invention

Generally, the invention relates to containers to contain paint during a painting procedure. More specifically, the invention relates to such containers capable of being easily moved about the floor by the painter during the painting procedure.

2. Description of the Prior Art

Various methods are known to apply paint to a wall surface. It may be mechanically sprayed on the wall surface without any paint retaining structure actually touching the wall surface. This method is not directly applicable to the present invention and will not be discussed further. Typically a paint retaining structural element will have paint placed on the paint retaining structural element with transfer of such paint occurring by wiping or rolling the paint retaining structural element on the wall surface. The two most common painting tools having applicable paint retaining structural elements are the paint brush and the paint roller. The present invention may be utilized with paint brushes to significantly enhance the painting experience during use of the paint brush. The present invention is generally related to use of the paint roller, and more particularly, to use with the paint roller deployed with a long handle. Paint rollers have a cylindrical portion with a paint retaining surface, such as a mat material, rotationally mounted to a manipulation part, typically in the form of a handle. Most modern paint roller handles have means to attach a long extension handle thereto, such as a female threaded cavity in the end of the handle to receive threads on a male end of the long extension handle. During use paint is gathered on the paint retaining surface of the cylindrical portion to a desired uniformity and density and then the paint retaining surface is rolled along the wall surface to transfer the paint to the wall surface.

Painters of wall surfaces have personal preferences for painting equipment utilized and the orientation of, and interaction with, that painting equipment during their respective painting. The following description depicts a typical conventional painting procedure performed on a large interior or exterior wall surface of a structure. The three most common methods of containment of the paint utilized for such a project are used during this description.

The first method is use of a bulk paint container, such as a round five gallon bulk paint bucket, and working directly from the round bulk paint container. Such use of round bulk paint buckets typically require use of an insert having a planar rolling surface positioned thereon with the insert placed partially into the round bulk bucket. In order to utilize the planar rolling surface for the intended use the bulk bucket will contain well less than the containment capacity of paint where a large portion of the insert is above the level of the paint. In use the paint roller will be placed in contact with the paint and then rolled along the planar surface of the insert to uniformly distribute the paint on the roller.

The second method is use of a large dedicated paint bucket designed to hold a relatively large quantity of paint, such as several gallons, while allowing use of a conventional paint roller. Such bulk paint buckets will typically either have a flat surface on them to roll the paint roller on above the paint contained in the bucket or will accept an insert having a planar rolling surface positioned thereon with the dedicated paint bucket.

The third method is use of a paint roller pan with an upward sloped rolling surface extending from a deeper paint containment end. Typically these paint roller pans contain no more than a gallon of paint at a time and are rectangular in shape, with slightly rounded corners, when viewed from above. Such paint roller pans will often have structures thereon to position the pan in a stable and secure manner on a ladder at an elevated position above the floor. This ladder placement method permits the painter to stand on the ladder during painting. This orientation is more often used with a handheld paint brush than with a paint roller. When a paint roller pan is used with a paint roller with long handle assembly, the paint roller pan will often rest on the floor adjacent the wall surface being painted.

Each of these three methods of paint containment, bulk paint container, large dedicated paint bucket and paint roller pan, suffer from various deficiencies. When used with a paint roller having an extension handle they are all most often used while the respective paint container is resting on the floor. This floor positioning allows the painter to easily use the long extension handle to manipulate the paint roller portion to deposit a desired amount of paint, and to a uniform manner, on the paint roller while the painter remains standing straight without bending over or stooping. The painter will then manipulate the extension handle to transfer the paint from the paint roller to the wall surface. With the extension handle this may be done from near floor level to near ceiling level while the painter remains standing straight without bending over or stooping. The main problem occurs when the painter has painted an area of the wall surface and moves to start painting the next adjacent portion of the wall surface. It then becomes necessary to physically move the paint container a similar distance or for the painter to move over to the paint container each time replenishment of a fresh supply of paint on the paint roller is required. Each of these options is time consuming. Eventually the paint container will be moved to a new location during a painting procedure. It being understood that bending, stooping or squatting to physically engage a heavy paint container has been known to cause injury to painters. Additionally, such activities, even in the absence of injury, tend to tire and fatigue the painter. It is also understood that such displacement of bulk paint container occasionally result in the spillage of paint onto the floor, or onto any protective covering placed on the floor during the painting procedure. Such spillage is expensive as it always wastes some paint and occasionally causes damages to objects not intended to have paint applied to.

As can be seen there remains a need for a paint bucket which will retain paint, allow easy and uniform placement of the paint on a paint roller having an extension handle and which can be easily moved about during the painting procedure as desired by the painter, all while the painter remains standing straight without bending or stooping. The present invention substantially fulfills these needs.

SUMMARY

In view of the foregoing disadvantages inherent in the known methods of containing paint during painting procedures, your applicant has devised a rollable paint bucket to retain paint during a painting procedure. The painting procedure is performed with a paint roller assembly having a paint roller, a paint roller retention assembly and an elongated handle. The paint roller retention assembly provides for axial rotation of the paint roller while the elongated handle provides for a significant spacing of a painter from the paint roller during the painting procedure. The rollable paint bucket has a body, a plurality of rolling members and means to position the rollable paint bucket. The body has a containment area to provide for containing a quantity of paint. The containment area is readily accessible for transfer of a portion of the paint contained in the containment area to the paint roller assembly during the painting procedure. The plurality of rolling members are attached relative to the body of the rollable paint bucket and provide for ready movement of the rollable paint bucket over a generally flat surface during the painting procedure. The means to position, in the preferred form of a paint roller resting area, provide for the paint roller of the paint roller assembly to be placed relative to the rollable paint bucket where the user may manipulate the elongated handle of the paint roller assembly to easily move the rollable paint bucket about on the generally flat surface during the painting procedure.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a rollable paint bucket which will be easily moved about the floor while the painter remains standing upright while painting with a paint roller with an extension handle.

Other objects include;

a) to provide for the rollable paint bucket to have a paint containment area and rolling surface area positioned in communication with the paint containment area.

b) to provide for the rollable paint bucket to have a paint roller resting area, which is generally behind and near an upper extent of the rolling surface area, for placement of the paint roller during manipulated movement of the rollable paint bucket where the painter will be able to easily manipulate movement of the rollable paint bucket about the floor.

c) to provide for the rolling surface for rolling of the paint roller to be angularly offset between horizontal and vertical while being significantly nearer to vertical than to horizontal.

d) to provide for the rollable paint bucket to receive in a secure manner an insert having the rolling surface thereon.

e) to provide for the rollable paint bucket to actively engage the insert with retaining structures at a lower extent of the insert and at an upper extent of the insert.

f) to provide for the rollable paint bucket to have attachable/detachable rolling members where the remainder of the rollable paint bucket is nestable for storage and transport when the rolling members are removed.

g) to provide for the rollable paint bucket to have a pivotal handle with a range of motion between a forward storage position where the pivotal handle is out of the way during painting and a pouring position where the pivotal handle extends above the rollable paint bucket for manipulation during a pouring procedure to remove unused paint from the rollable paint bucket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
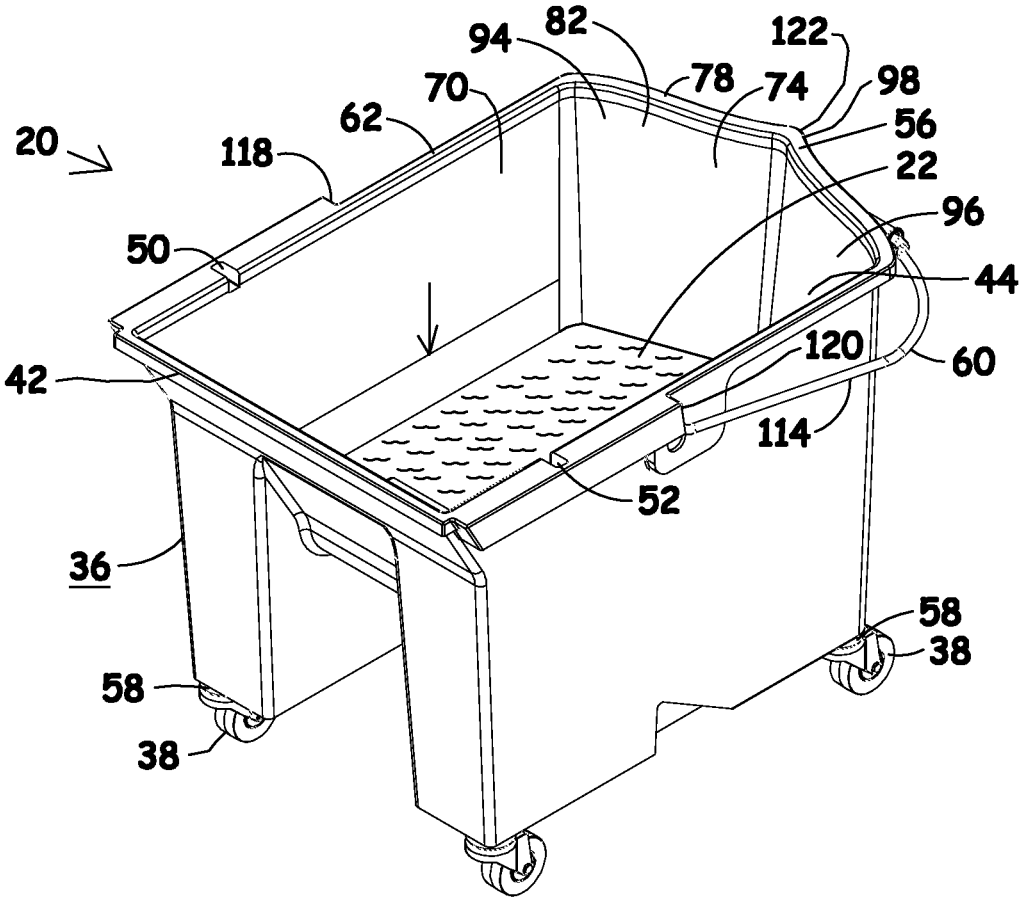
FIG. 1 is a perspective view of a rollable paint bucket, with workpiece paint therein and without a workpiece insert installed.

Many different devices having features of the present invention are possible. The following description describes the preferred embodiment of select features of those devices and various combinations thereof. These features may be deployed in various combinations to arrive at various desired working configurations of devices.

Reference is hereafter made to the drawings where like reference numerals refer to like parts throughout the various views.

The invention is a rollable paint bucket capable of retaining paint and being easily moved about as desired by the painter during a painting procedure. Such movement will typically be on the floor of the area being painted. As is conventionally known for painting, the floor area will typically be covered with some temporary covering, such as plastic sheet material or a canvas tarp. It being understood that applicable rollable paint buckets will be on top of such coverings and will roll about on those coverings.

In order to avoid repetitive bending over and standing up, applicable rollable paint buckets will provide for the painter to utilize a conventional paint roller, with a conventional elongated handle extending therefrom, during the painting procedure. This combination of the rollable paint bucket with the paint roller on a long handle permits the painter to stand upright during painting of a relatively large area. The painter will gather paint on the paint roller, apply that paint to a surface being painted in a repetitive manner and move the rollable paint bucket to a new position all without moving significantly from the standing posture. When the painter moves slightly to position at a new unpainted area of the surface being painted, the painter will move the rollable paint bucket a generally equal distance as their move utilizing manipulation of the handle of the paint roller. This eliminates stooping to move the paint bucket and eliminate having to lift the paint bucket off of the floor. This also provides for the painter retain the paint roller assembly during an entire painting session from the time of placement of paint in the rollable paint bucket until either the paint supply is depleted or until the area to be painted with the paint rolling is painted. In this manner a large surface area may be painted without requiring the painter to bend over even once or having to pick up the paint bucket even once or to set down, or otherwise release, the paint roller assembly.

The term painting procedure as used herein refers generally to the gathering of workpiece paint from a rollable paint bucket having features of the present invention onto a workpiece paint roller assembly for some useful purpose. It is only necessary that the comparative rollable paint bucket being considered have the ability to perform those functions. It is envisioned that painters will utilize rollable paint bucket having features of the present invention with a workpiece paint brush without utilizing the workpiece paint roller assembly. Such possible exclusion of utilization of the workpiece paint roller assembly with an applicable rollable paint bucket should not be viewed as limiting the scope of the present invention.

Overview

Figure 6:
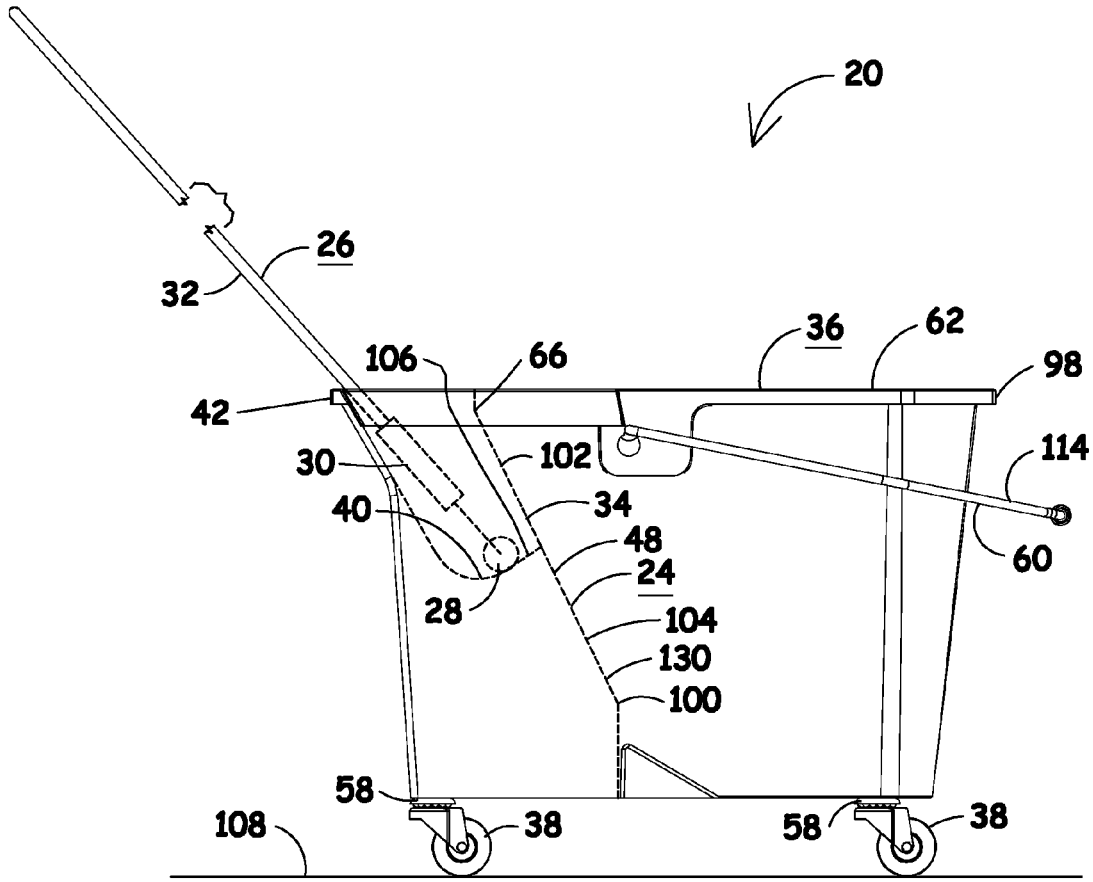
FIG. 6 is a side elevational view of the rollable paint bucket depicted in FIG. 1 with the workpiece insert, portions of a workpiece paint roller assembly and select portions of the rollable paint bucket depicted with dashed 'hidden lines' to depict placement and orientation of various components.
Figure 7:
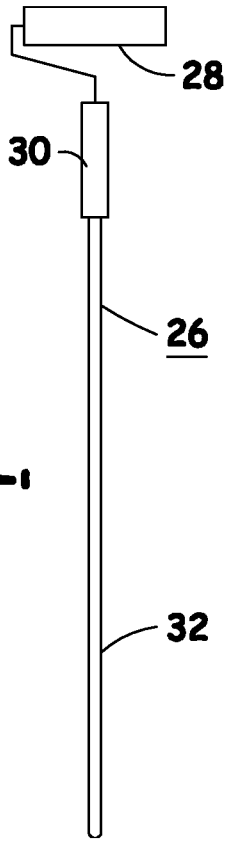
FIG. 7 is a side elevational view of a workpiece paint roller assembly and labeled as 'Prior Art'.

A rollable paint bucket 20 retains workpiece paint 22, shown in FIG. 1, and a workpiece insert 24, shown in FIG. 6, during a painting procedure performed with a workpiece paint roller assembly 26, shown in FIG. 6 and FIG. 7. It being understood that the various workpieces, and their respective parts, are not part of the present invention.

Certain workpieces will be utilized with the present invention and are recited within the claims as workpieces. Such workpieces are recited in the claims and in this specification to give meaning to the various claimed features of the present invention. Again, it is noted that the workpieces form no part of the present invention.

Workpiece Paint Roller Assembly

The present invention utilizes a workpiece paint roller assembly having an elongated handle. While various styles are commercially available, and even more in the prior art, generally all such known paint roller assemblies are applicable for use with the present invention.

FIG. 7 depicts workpiece paint roller assembly 26 having various components, all conventionally known in the art, and labeled as 'Prior Art'. A workpiece paint roller 28, a workpiece paint roller retention assembly 30 and an elongated workpiece handle 32 form workpiece paint roller assembly 26. Workpiece paint roller retention assembly 30 provides for axial rotation of workpiece paint roller 28 on workpiece paint roller assembly 26. Elongated workpiece handle 32 is attached to workpiece paint roller retention assembly 30 and provides for significant spacing of the user, no shown in any of the views, from workpiece paint roller 28 during the painting procedure.

Workpiece Insert

Rollable paint buckets having features of the present invention may utilize a workpiece insert to provide a rolling surface to roll the workpiece paint roller against. In the most preferred embodiment the rollable paint bucket will have means, in the form of structural configurations, to secure the workpiece insert relative to the body of the rollable paint bucket. In the most preferred embodiment the workpiece insert will have corresponding means, in the form of structural configurations, to secure the workpiece insert relative to the body of the rollable paint bucket. Ideally on the workpiece insert this will take the structural form of opposing extending tabs at, or near, an upper extent of the workpiece insert and a frame member extending across a lower extent of the workpiece insert. Preferably the workpiece insert will have an angular change in the rolling surface nearer to the lower extent of the workpiece insert than to the upper extent of the workpiece insert. This provides for a larger primary surface positioned elevationally above a secondary surface.

In the most preferred embodiment workpiece insert 24 will be deployed on rollable paint bucket 20 during performance of the painting procedure. The specific workpiece insert 24 depicted is not prior art and is the subject of a separate Patent application filed at the time of filing of this application by the applicant.

Workpiece insert 24 provides for a rolling surface 34, shown in FIG. 6, for distribution of workpiece paint 22 onto workpiece paint roller 28 of workpiece paint roller assembly 26 during the painting procedure. Rolling surface 34 provides for a generally uniform distribution of a desired quantity of workpiece paint 22 on workpiece paint roller 28 of workpiece paint roller assembly 26.

Rollable Paint Bucket

Figure 3:
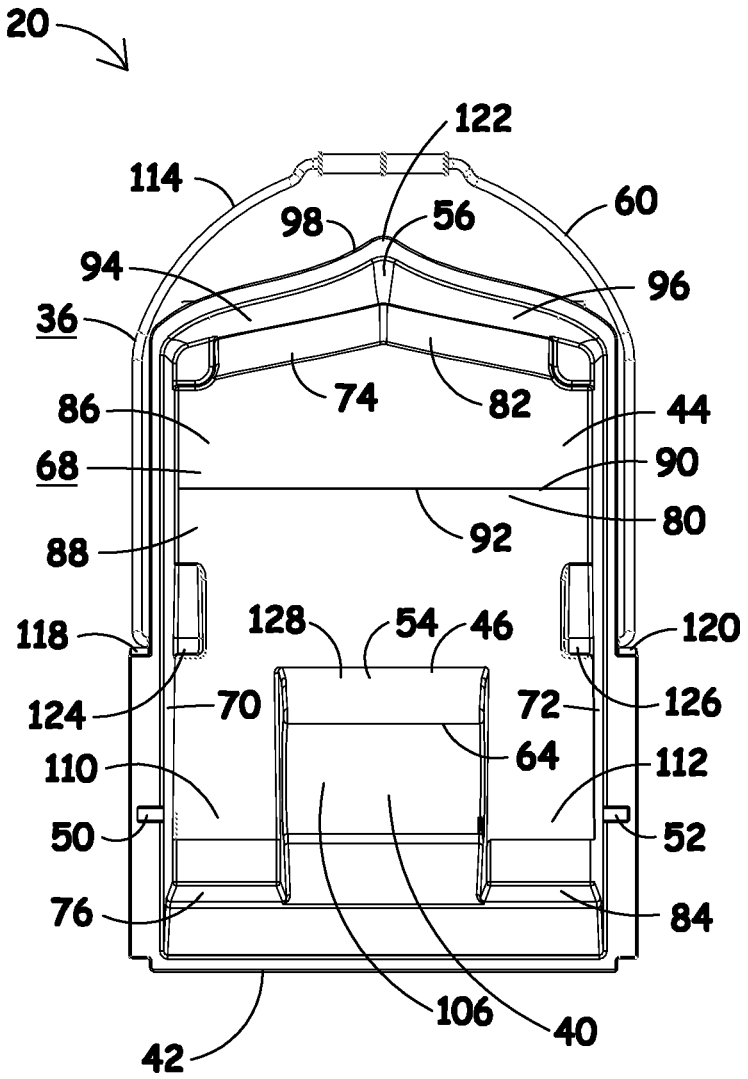
FIG. 3 is a top plan view of the rollable paint bucket depicted in FIG. 1.
Figure 4:
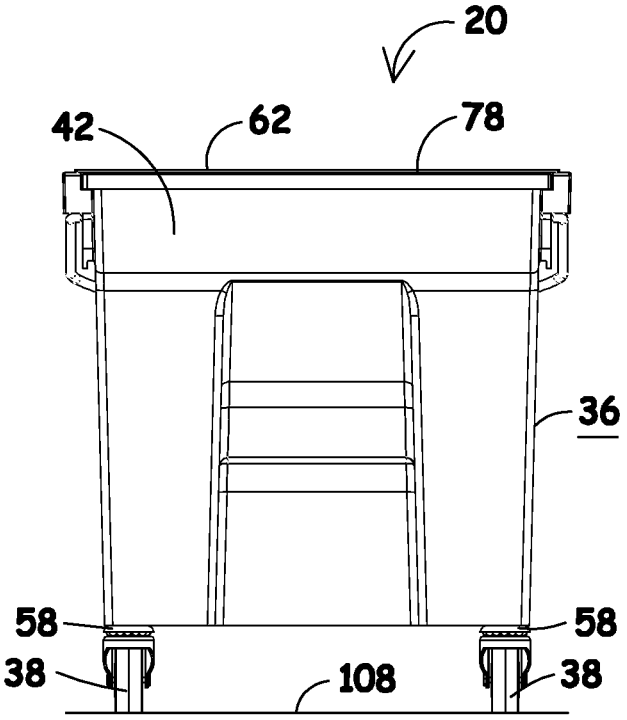
FIG. 4 is a rear elevational view of the rollable paint bucket depicted in FIG. 1.
Figure 5:
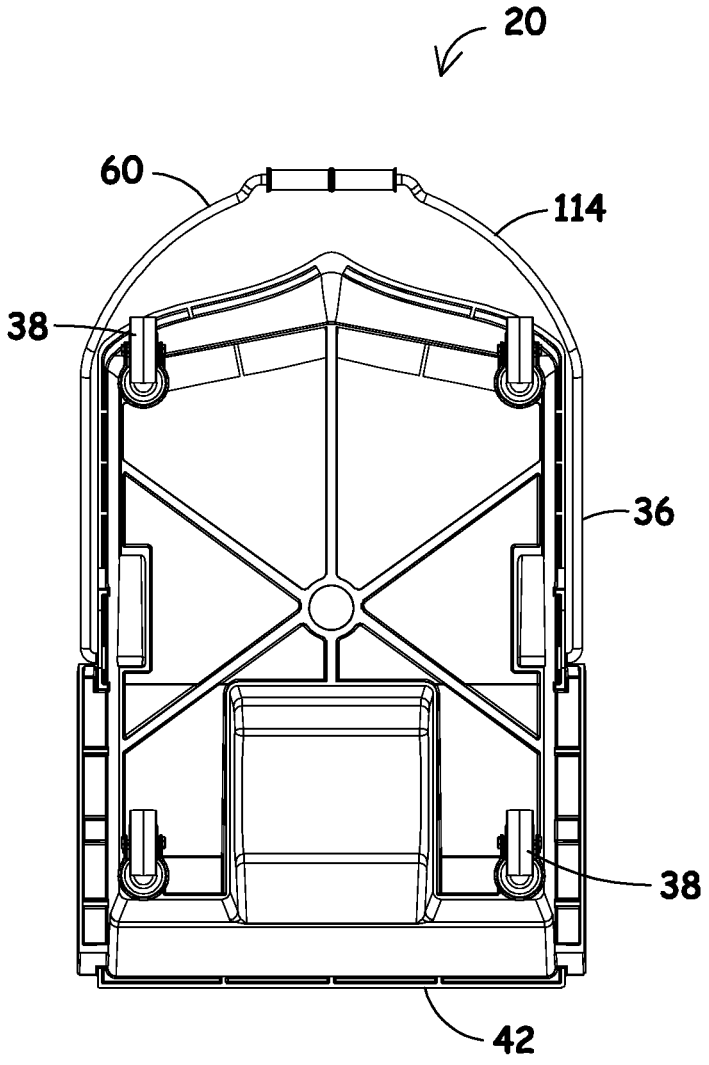
FIG. 5 is a bottom plan view rollable paint bucket depicted in FIG. 1.

Rollable paint bucket 20 will have a body 36, a plurality of rolling members 38, some form of positioning means, such as the use of a paint roller resting area 40, shown in FIG. 3 and FIG. 6, with workpiece paint roller assembly 26, and a user accessible end 42. Body 36 will have a containment area 44, shown in FIG. 1 and FIG. 3, where workpiece paint 22 is stored. Additionally, rollable paint bucket 20 will have either a paint roller contact area 46, shown in FIG. 3, or will utilize some form of workpiece insert 24 to provide a paint roller contact area 48, shown in FIG. 6. When some form of workpiece insert 24 is utilized, some form of workpiece insert securement means, such as opposing upper securement positions 50 and 52, shown in FIG. 1 and FIG. 3, will be utilized. When some form of workpiece insert 24 is utilized, it is preferred that a backing surface 54, shown in FIG. 3, be provided on rollable paint bucket 20 to contact the deployed workpiece insert 24. In certain embodiments rollable paint bucket 20 will have a forward pouring area 56, shown in FIG. 1 and FIG. 3, a plurality of rolling member attachment positions 58 and a pivotal handle 60. Each rolling member attachment position 58 will removably accept attachment of a respective rolling member 38.

Preferably rollable paint bucket 20 will have user accessible end 42 where the user, not shown in any of the views, would routinely stand during use of rollable paint bucket 20 during the painting procedure. Such placement preferably placing the applicable paint roller contact area 46 or 48 generally between user accessible end 42 and containment area 44.

All reference herein to orientation on the horizontal utilize user accessible end 42 as the rear of rollable paint bucket 20 with the opposing end being the front. Obviously these orientations can be reversed without having any effect on the underlying invention. All orientations to upper and lower envision that the applicable rollable paint bucket is resting on a floor in position to be utilized for the stated purpose.

Rollable paint buckets having features of the present invention may have a fairly wide range of workpiece paint capacities. Preferable rollable paint buckets will have a usage limit of about two (2) US gallons, or slightly less. This capacity provides for the rollable paint bucket to be small enough to be readily handled, stored and transported.

Body

Body 36 preferably will be formed of a plastic and be of a single piece. While body 36 may have many shapes, dimensions and configurations, preferably it will be generally rectangular, as depicted in the various views, for easy use with workpiece paint roller assembly 26.

Body 36 will have an upper extent 62 which, in preferred embodiments, will exist either at an upper extent 64, shown in FIG. 3, of paint roller contact area 46 or when some form of workpiece insert 24 is utilized, at an upper extent 66, shown in FIG. 6, of paint roller contact area 48 on workpiece insert 24. Paint roller contact area 46 of body 36 is backing surface 54 when workpiece insert 24 is deployed, but in the absence of use of workpiece insert 24, it can be utilized as paint roller contact area 46.

Containment Area

Containment area 44 provides for containment of a quantity of workpiece paint 22 where the user may easily access containment area 44 to transfer a portion of workpiece paint 22 contained in containment area 44 to workpiece paint roller assembly 26 during the painting procedure.

Containment area 44 will a base 68, shown in FIG. 3, opposing side walls 70, shown in FIG. 1 and FIG. 3, and 72, shown in FIG. 3, a front wall 74, shown in FIG. 1 and FIG. 3, and a rear wall 76, shown in FIG. 3. Base 68 and each wall 70, 72, 74 and 76 may have various configurations, including structural portions incorporated thereon and distinctly identifiable surfaces, without negating the conventional meanings of the terms wall and/or base. Similarly, base 68 and each wall 70, 72, 74 and 76 may have structural portions which extend to adjacent members without negating the conventional meanings of the terms wall and/or base. Containment area 44 will have an upper extent 78, shown in FIG. 1, a lower extent 80, shown in FIG. 3, a forward extent 82, shown in FIG. 1 and FIG. 3, and a rearward extent 84, shown in FIG. 3. It being understood that the term extent as used herein is broadly defined and can include surfaces which are not planar and which are not entirely vertical or horizontal and which can further be formed from multiple cooperating surfaces. The term upper extent as applied to containment area generally defines the highest plane where workpiece paint may exist without overflowing the surrounding walls or other containing structures.

Base 68 of containment area 44 preferably is formed of a forward planar surface 86, shown in FIG. 3, and a rearward planar surface 88, shown in FIG. 3. Forward planar surface 86 and rearward planar surface 88 meet at a linear juncture 90, shown in FIG. 3, which extends completely across containment area 44. Forward planar surface 86 slightly slopes upward from linear juncture 90 while rearward planar surface 88 slightly slopes upward from linear juncture 90. This arrangement provides for linear juncture 90 to be centrally positioned in base 68 and to form a lowest gathering extent 92, shown in FIG. 3, of containment area 44. By this arrangement when workpiece paint 22 is at a low level within containment area 44 it will gather at lowest gathering extent 92 where it will be fully accessible to the user.

It is envisioned that the containment area of the rollable paint bucket may receive workpiece paint to a high operational paint capacity level with radially surrounding walls of an elevational height sufficient to contain the workpiece paint at this level and an elevationally higher portion extending above those radially surrounding walls. This elevationally higher portion may simply be a continuation of a wall member which acts to retain workpiece paint. The high operational paint capacity level in practice will actually exist in a slight range of levels depending upon user preferences. It being understood that such high operational paint capacity level cannot overflow the radially surrounding wall barriers. This elevationally higher portion would have a workpiece paint roller contact area, or means to retain a workpiece insert having such a workpiece paint roller contact area, and means to drain runoff workpiece paint back into the area retaining workpiece paint to the high operational paint capacity level. In such embodiments the containment area provides for containment of workpiece paint both to the high operational paint capacity level and during interaction with the workpiece paint roller contact area of the insert, or the workpiece paint roller contact area of the rollable paint bucket, elevationally about the high operational paint capacity level. This provides for full use of the workpiece paint roller contact area, either directly on the rollable paint bucket or on a workpiece insert, for drainage of excess workpiece paint from the workpiece paint roller contact area at a much higher elevational level than the high operational paint capacity level.

Forward Pouring Area

Forward pouring area 56 provides for ready pouring of workpiece paint 22 from containment area 44 during a workpiece paint removal procedure to remove workpiece paint 22 from rollable paint bucket 20. Preferably forward pouring area 56 will be centered on rollable paint bucket 20 with convergent surfaces 94 and 96, both shown in FIG. 1 and FIG. 3, leading to forward pouring area 56. Preferably forward pouring area 56 is positioned at a forward extent 98 of rollable paint bucket 20 distal from user accessible end 42. Rollable paint bucket 20 is configured where the user may hold body 36 with one hand and pivotal handle 60 in their other hand and readily and easily manipulate rollable paint bucket 20 to remove workpiece paint 22 using forward pouring area 56.

Paint Roller Contact Area (Rolling Surface for Paint Roller)

As previously disclosed herein, either paint roller contact area 46 positioned directly on rollable paint bucket 20 will exist or, when some form of workpiece insert 24 is utilized, paint roller contact area 48 on workpiece insert 24 will exist. As depicted in the preferred embodiment rollable paint bucket 20 may be configured to operate with or without workpiece insert 24 where either paint roller contact area 46 or paint roller contact area 48 will be available for use. For the following description it will be assumed that workpiece insert 24 is utilized having paint roller contact area 48 positioned thereon.

Paint roller contact area 48 on workpiece insert 24 is positioned on body 36 relative to containment area 44. Paint roller contact area 48 provides for a rolling of workpiece paint roller 28 along paint roller contact area 48 to distribute a desired quantity of workpiece paint 22 in a desired uniformity from containment area 44 of rollable paint bucket 20 onto workpiece paint roller 28. Paint roller contact area 48 preferably is positioned on user accessible end 42 of rollable paint bucket 20 relative to containment area 44. This provides for the user to gather workpiece paint 22 on workpiece paint roller 28 from containment area 44, then move workpiece paint roller 28 toward the user and engage paint roller contact area 48. Paint roller contact area 48 has a lower extent 100, shown in FIG. 6, and upper extent 66. Paint roller contact area 48 has a planar surface 102, shown in FIG. 6, thereon having an orientation plane 104, shown in FIG. 6, when installed in rollable paint bucket 20 which is significantly offset relative to vertical. Orientation plane 104 of planar surface 102 of paint roller contact area 48 is sloped toward user accessible end 42 of rollable paint bucket 20 from lower extent 100 to upper extent 66. This provides for paint roller contact area 48 to be further back toward user accessible end 42 at upper extent 66 relative to lower extent 100.

Positioning Means

The term positioning means as used herein refers to providing the user with the ability to place a workpiece paint roller of a workpiece paint roller assembly relative to an applicable rollable paint bucket and for the user to manipulate an elongated workpiece handle of the workpiece paint roller assembly to move the rollable paint bucket about a surface. Preferably this will take the form of a specific structural configuration on the applicable rollable paint bucket where the workpiece paint roller will make contact, such as a paint roller resting area. Ideally, the deployed paint roller resting area will accept placement of the workpiece paint roller during user controlled movement of the rollable paint bucket as well as during times that the user merely desires to release the workpiece paint roller assembly in order to rest or to perform some other task where the workpiece paint roller assembly will remain and not fall.

Paint roller resting area 40 of rollable paint bucket 20 is positioned near user accessible end 42 and generally near upper extent 62 of body 36 of rollable paint bucket 20. Paint roller resting area 40 receives workpiece paint roller 28 of workpiece paint roller assembly 26. Paint roller resting area 40 has a paint roller resting surface 106, shown in FIG. 3 and FIG. 6, which workpiece paint roller 28 will at least partially contact while in paint roller resting area 40. Once workpiece paint roller 28 of workpiece paint roller assembly 26 is resting in paint roller resting area 40 the user, not shown, can release elongated workpiece handle 32 and workpiece paint roller assembly 26 will remain on rollable paint bucket 20 without falling off with elongated workpiece handle 32 elevated significantly above the ground, depicted as surface 108. When workpiece paint roller 28 of workpiece paint roller assembly 26 is resting in paint roller resting area 40 workpiece paint roller 28 is positioned at an elevational height above workpiece paint 22 contained in containment area 44 of rollable paint bucket 20. Opposing paint drainage areas 110 and 112, both shown in FIG. 3, provide for at least a portion of workpiece paint 22 deposited in paint roller resting area 40 from workpiece paint roller 28 to drain into containment area 44 of body 36 of rollable paint bucket 20. Paint roller resting surface 106 preferably has a curved shape generally complementary to a portion of a shape of workpiece paint roller 28 of workpiece paint roller assembly 26.

Once workpiece paint roller 28 is positioned in paint roller resting area 40 the user may manipulate elongated workpiece handle 32 of workpiece paint roller assembly 26 to guide and move rollable paint bucket 20 around surface 108.

Backing Surface

When workpiece insert 24 is utilized backing surface 54 is positioned within, or immediately adjacent to, containment area 44. Backing surface 54 preferably will at least partially contact workpiece insert 24 when workpiece insert 24 is installed in rollable paint bucket 20. Backing surface 54 preferably will contact at least a substantial portion of the rear of paint roller contact area 48 of workpiece insert 24.

Rolling Members

Rollable paint buckets having features of the present invention will have some rolling members which will permit movement of the rollable paint bucket across a generally flat surface. The art is rich with rolling members, including wheeled embodiments, which may be utilized to provide this required feature. In the most preferred embodiments the rolling members will be attachable relative to the body of such embodiments. Ideally such attachment to the body utilizes an attachment method which permits removal of the rolling members by the user and reattachment of the rolling members by the user. This arrangement is useful during storage or transport, but is also useful during cleaning of the applicable rollable paint bucket.

A plurality of rolling members 38 are positioned where rollable paint bucket 20 may be rolled about a generally flat surface, such as a floor. Preferably each rolling member 38 will be attached to body 36 although it is possible to provide for attachment to a base member which is then positionable relative to body 36. Rolling members 38 provide for ready movement of rollable paint bucket 20 over a generally flat surface, such as surface 108, during the painting procedure. As more fully disclosed below it is preferred that each rolling member 38 be detachably attachable to a respective rolling member attachment position 58.

It is preferred that any deployed rolling members be capable of permitting the applicable rolling paint bucket to be turned easily and rolled in any desired direction. A class of rolling members conventionally known in the art provides this feature without requiring swiveling of the rolling member, and such rolling members may be utilized. Alternatively, rolling members conventionally known in the art swivel about a vertical axis and it is preferred that such rolling members be utilized for the present invention.

It is rare to have a sloped surface where painting is occurring and where it is desired to place the rollable paint bucket. For those occasions it is a desire that applicable rollable paint buckets having at least one rolling member with locking means to prevent rotation of the rolling member. This locking of a select wheel will prevent significant movement of the rollable paint bucket. Various locking assemblies for applicable rolling members are known in the art and many of these may be utilized with the present invention. When deployed, it is preferred that the user be able to manipulate the locking of the rolling member and the unlocking of the rolling member while standing at the user accessible end of the respective rollable paint bucket. Ideally such locking and unlocking will be performed while the user stands upright without requiring the user to bend, stoop or squat. This is easily provided for by having the structural components of the locking mechanism operational using a portion of the foot of the user, not shown in any of the views. Such foot operated locking mechanisms for rolling members are well known in the art and many of these may be utilized with the present invention.

Plurality of Rolling Member Attachment Positions

In a less preferred embodiment of rollable paint bucket the deployed rolling members may be permanently attached to the rollable paint bucket. Similarly in a less preferred embodiment to that depicted in the drawings, the deployed rolling member may be attached, removably or permanently, to a separate structural component from the body of the rollable paint bucket. This separate structural component would then be attached to, or positioned relative to, the body of an applicable rollable paint bucket.

Body 36 will have a plurality of rolling member attachment positions 58. Each rolling member attachment position 58 provides for attachment of a respective rolling member 38. The preferred method of providing rolling members 38 directly on body 36 utilizing rolling member attachment positions 58 provides for body 36 to be nestable with identical bodies 36 for ready transport and/or storage.

Pivotal Handle

Preferably applicable rollable paint buckets will have a handle for those occasions when the user desires to carry the bucket around rather than rolling the bucket. It is a strong desire that any handle not interfere with the function of the applicable rollable paint bucket when used for painting or when being rolled about. Various designs for handles are known in the art to provide for carrying desire, and which may be utilized with the present invention without interfering with operation of the rollable paint bucket when being used for painting. A simple pivotal handle which straddles the bucket is preferred. Ideally such a pivotal handle will extend across the bucket from the opposing longitudinal sides. In the most preferred embodiment the design of the rollable paint bucket will provide for level swinging balance of the bucket when the bucket is empty of paint and when the bucket has any level of paint in the respective containment area.

In order to ensure that the pivotal handle not interfere with operation of the rollable paint bucket during use, the pivotal handle will preferably have a resting position. This resting position provides for the rollable paint bucket to be fully utilized during the painting procedure without undue interference by the pivotal handle. This is easily accomplished by having the resting position for the pivotal handle at a forward end of the rollable paint bucket distal from the user accessible end.

It is also a strong desire that the user be able to engage the pivotal handle with one hand during a pouring operation to remove paint from the containment area of the rollable paint bucket. During this pouring operation the user uses would use their other hand to hold some portion of the body of the rollable paint bucket. In order to provide for this desired feature the pivotal handle will have a range of motion. This range of motion extends from the resting position to a position which leaves the handle angled upward significantly from horizontal but significantly being a vertical carrying orientation. This arrangement, where a gripping location on the pivotal handle is spaced a significant distance from the body of the rollable paint bucket, provides for easy pouring of the paint from the rollable paint bucket.

Figure 2A:
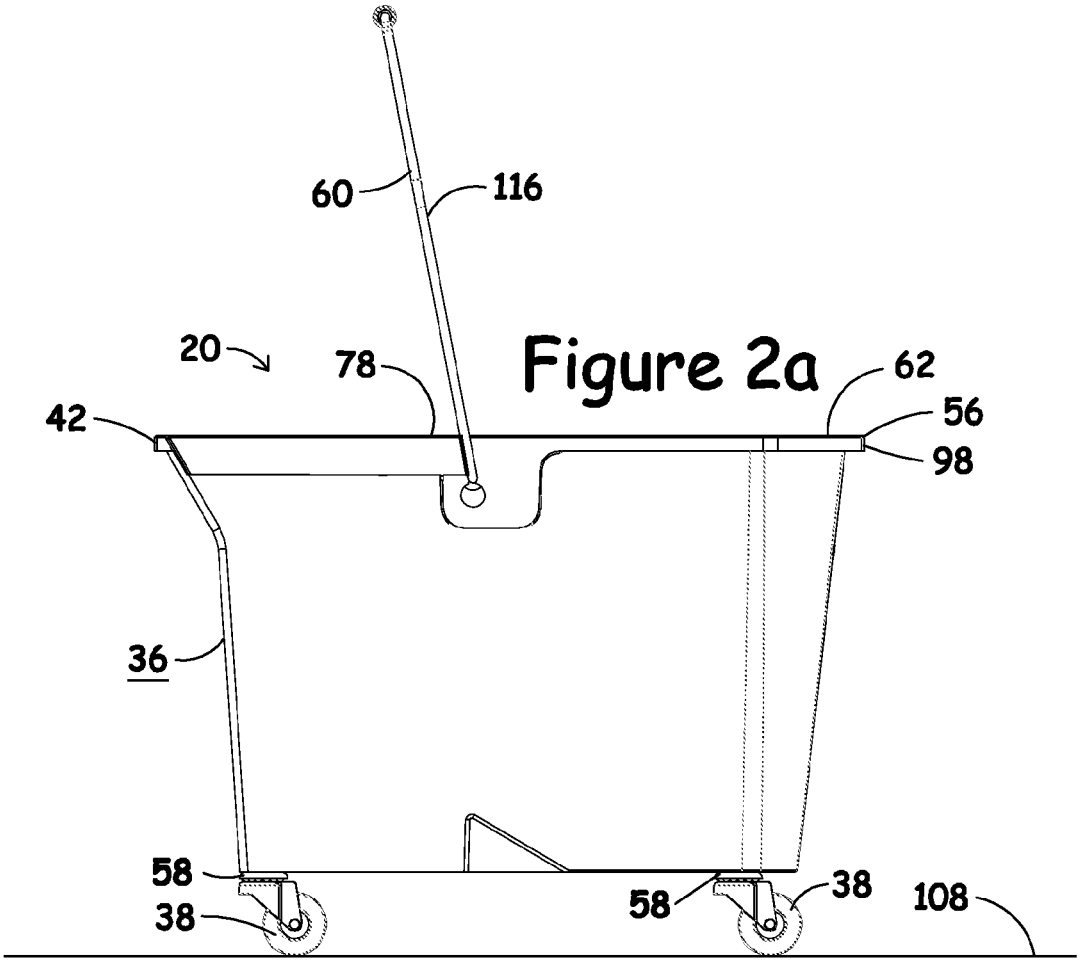
FIG. 2*a* and FIG. 2*b* are side elevational views of the rollable paint bucket depicted in FIG. 1 with the pivotal handle depicted at opposing end of a range of pivotal motion.
Figure 2B:
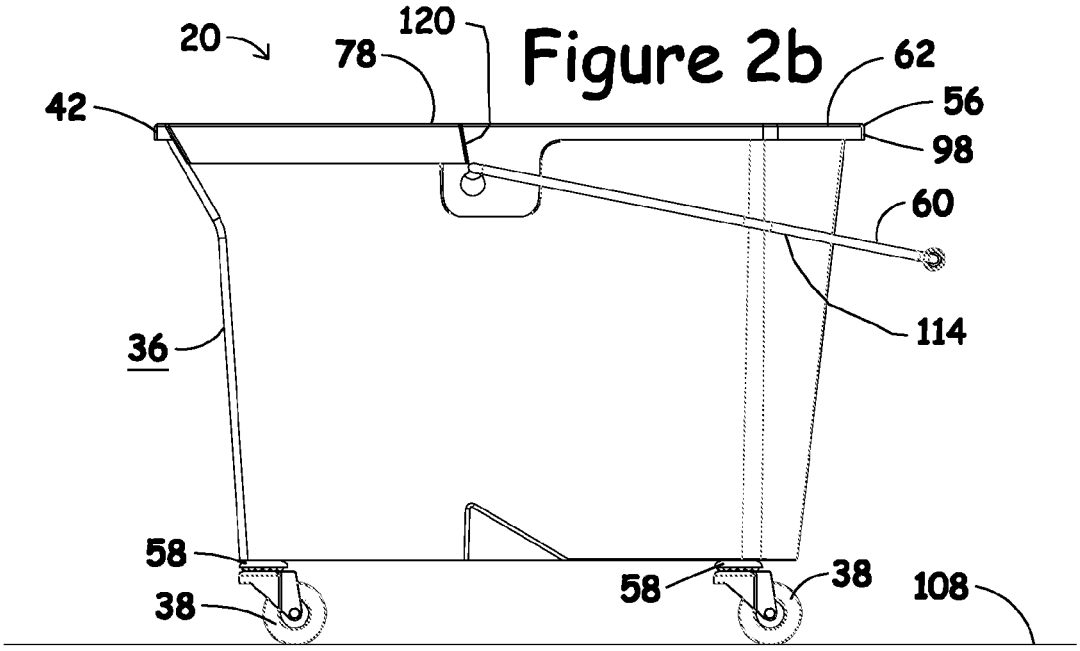

Pivotal handle 60 is secured relative to body 36 of rollable paint bucket 20 where displacement of pivotal handle 60 occurs within a range of motion between a resting position 114, shown in FIG. 2*b*, and a pouring position 116, shown in FIG. 2*a*. Resting position 114 provides for rollable paint bucket 20 to be fully utilized during the painting procedure without undue interference by pivotal handle 60. Pouring position 116 provides for pivotal handle 60 to be utilized by the user, along with secondary contact with rollable paint bucket 20, to provide for manipulation of rollable paint bucket 20 during a workpiece paint removal procedure. Opposing pivotal contact surfaces 118 and 120, both shown in FIG. 1 and FIG. 3, on body 36 provide for pivotal handle 60 to not pivot being pouring position 116 further toward user accessible end 42. This arrangement ensures that a pouring operation, as would occur when pivotal handle 60 is in pouring position 116 and rollable paint bucket 20 is angularly tipped, will easily occur. A paint pouring guide 122, shown in FIG. 1 and FIG. 3, on forward pouring area 56 is in communication with containment area 44. Paint pouring guide 122 is positioned at forward extent 98 of rollable paint bucket 20 to provide for controlled displacement of workpiece paint 22 from containment area 44 of rollable paint bucket 20 into a workpiece container, not shown, such as a conventional paint can.

Workpiece Insert Securement Means

As disclosed, applicable rollable paint buckets can have a workpiece insert having a paint roller rolling surface thereon for rolling a workpiece paint roller on to uniformly distribute workpiece paint on the workpiece paint roller. When such a workpiece insert is utilized the rollable paint bucket having features of the present invention will have a dedicated place for the workpiece insert and some structural configuration to secure the workpiece insert in an operational orientation. Workpiece insert securement means, in the form of retaining structures on the rollable paint bucket, provides for retention of the workpiece insert relative to the containment area of the body of the rollable paint bucket during the painting procedure. Preferably such retaining structures on the rollable paint bucket will engage the workpiece insert at, or near, an upper extent of the workpiece insert. This provides for easy access for the user during placement of the workpiece insert and during removal of the workpiece insert. Preferably retaining structures on the rollable paint bucket will also engage the workpiece insert at, or near, a lower extent of the workpiece insert. In the most preferred embodiment both upper and lower securement positions are utilized. Ideally this will involve slide in type upper and lower securement positions where the workpiece insert can only be removed by a generally vertical lifting. This arrangement is ideal when combined with the preferred angular offset of a primary surface of the workpiece insert from true vertical. By this arrangement the workpiece insert cannot be incidentally displaced from a deployed orientation placement via the rolling action of the workpiece paint roller on the primary surface of the workpiece insert.

Workpiece insert securement means, depicted as opposing upper securement positions 50 and 52 and lower securement positions 124, 126 and 128, all shown in FIG. 3, provide for retention of workpiece insert 24 relative to containment area 44 of body 36 of rollable paint bucket 20 during the painting procedure. Workpiece insert 24 provides rolling surface 34 for distribution of workpiece paint 22 onto workpiece paint roller 28 of workpiece paint roller assembly 26 during the painting procedure. Opposing upper securement positions 50 and 52 on body 36 are generally at upper extent of body 36. Lower securement positions 124, 126 and 128 on body 36 are generally near lower extent 80 of containment area 44. Opposing upper securement positions 50 and 52 on body 36 are more toward rearward extent 84 of containment area 44 than are lower securement positions 124, 126 and 128. This arrangement provides for a substantial portion of workpiece insert 24 to be retained at an angular orientation 130, shown in FIG. 6, offset from vertical. In the most preferred embodiment depicted, workpiece insert 24 contacts backing surface 54 of rollable paint bucket 20 to further secure workpiece insert 24 in place. As depicted opposing upper securement positions 50 and 52, lower securement positions 124, 126 and 128 and backing surface 54 cooperate to provide for retention of workpiece insert 24 against backing surface 54 at angular orientation 130, which is significantly offset from vertical. While lower securement positions 124, 126 and 128 are depicted as multiple engagement positions, a single spanning engagement structure or merely opposing positions, similar to upper securement positions 50 and 52, are envisioned.

Workpiece Liner

Rollable paint buckets having features of the present invention can be fitted with a workpiece liner to contact the workpiece paint. Workpiece liners can protect many of the surfaces of the rollable paint bucket to which is fitted from contact with, and accumulation thereon of, workpiece paint. A workpiece liner also will make cleanup of the rollable paint bucket fitted with a workpiece liner much easier and far less time consuming. If desired the workpiece liner can be left on the rollable paint bucket for extended periods of time spanning multiple painting sessions, including allowing remaining workpiece paint to dry. After an unacceptable accumulation of residual paint, or when changing to use another type or color of paint in the rollable paint bucket, the used workpiece liner can be removed and a fresh liner installed.

The workpiece liner preferably will be configured to fit any of the various structural configurations of the specific embodiment of the rollable paint bucket upon which it will be deployed. Rollable paint buckets having features of the present invention will preferably be formed of a plastic within molds using an injection molding process. Due to the limitation that such rollable paint buckets will have to be releasable from the mold during the injection molding process, workpiece liners can be formed which will slip into, and snugly fit, a respective embodiment of rollable paint bucket.

Preferably the workpiece liner will fit within the rollable paint bucket covering all surfaces upon which workpiece paint will routinely make contact. This will include the containment area and the paint roller resting area, including the opposing paint drainage areas, and any areas between these two areas. Preferably, the workpiece liner will overlap any of the radially disposed upper edges of the rollable paint bucket.

The workpiece liner will be formed of a suitable paint impermeable material. The workpiece liner can be formed of a plastic sheet material in a vacuum molding process. Alternatively, the workpiece liner can be formed of a plastic using an injection molding process. Other applicable construction methods may be utilized. Both the vacuum molding and the injection molding options are capable of creating a relatively rigid, free standing, workpiece liner which will be easier to install and remove than a flexible workpiece liner. It is possible to form the workpiece liner from a much more pliant material having the desired shape and configuration. This type would have the advantage of being foldable for easy packaging, transport and storage. This type, while more time consuming to install and remove from applicable rollable paint buckets than the rigid or semi-rigid type, would be easier to dispose of as it can more readily be gathered from the edges and may be gathered into a smaller area for subsequent disposal.

When a workpiece liner is utilized with the rollable paint bucket preferably a workpiece insert will be used. The workpiece liner, of any applicable construction type, preferably will be installed in the rollable paint bucket with the workpiece insert installed subsequent to installation of the workpiece liner. This provides for the paint roller contact area on the workpiece insert to be exposed for use as the paint roller rolling surface. Of course it is envisioned that the surface of the workpiece liner, supported by underlying surfaces of the rollable paint bucket, can be used as the paint roller rolling surface directly.

With either the rigid or semi-rigid workpiece liner or the more pliant foldable workpiece liner various securement methods can be utilized to ensure that the workpiece liner remains in a deployed orientation on the rollable paint bucket. Preferably such securement methods utilize the upper radial edge of the workpiece liner, and corresponding contacting portions of the rollable paint bucket, to secure the workpiece liner relative to the rollable paint bucket. Of course, the simplest securement method involves taping of the workpiece liner to the exterior upper and/or side surfaces of the rollable paint bucket. More complicated securing devices, such as pressure bearing clips, positioned on the rollable paint bucket may be utilized. Yet another applicable option involves a series of snap type couplings having male and female portions. One set of members would be positioned on the rollable paint bucket while corresponding, and opposing, members would be positioned on the workpiece liner. Once the workpiece liner is positioned relative to the rollable paint bucket each set of the snap type couplings on the workpiece liner and the rollable paint bucket would be fastened to secure the workpiece liner to the rollable paint bucket. Other applicable securement methods, conventionally known in the art, can be used.

A lid, either completely removable or hinged, preferably will be provided with rollable paint buckets having features of the present invention. This will provide for leaving the rollable paint bucket for brief breaks from painting without undue concern that the condition of paint contained within the rollable paint bucket will deteriorate.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rollable paint bucket to retain workpiece paint during a painting procedure performed with a workpiece paint roller assembly, the workpiece paint roller assembly having a workpiece paint roller, a workpiece paint roller retention assembly and an elongate workpiece handle, the workpiece paint roller retention assembly to provide for axial rotation of the workpiece paint roller, the elongated workpiece handle attached to the workpiece roller retention assembly to provide for significant spacing of the user from the workpiece paint roller during the painting procedure, the rollable paint bucket comprising:

a) a body having:

i) a containment area to provide for receiving and containing a quantity of the workpiece paint, the containment area readily accessible for transfer of a portion of the workpiece paint contained in the containment area to the workpiece paint roller assembly during the painting procedure; said containment area being defined by a lower base that forms a lower extent, a wall section attached to and extending upwardly from said base and an upper extent at the top of said wall section;

ii) a plurality of rolling member attachment positions, and wherein each of the rolling members is detachably attachable to a respective rolling member attachment position;

and wherein the body of the rollable pain bucket is nestable with another body for ready transport;

b) a plurality of rolling members attached relative to the body of the rollable paint bucket, the rolling members to provide for ready movement of the rollable paint bucket over a generally flat surface during the painting procedure;

c) positioning means to provide for the workpiece paint roller of the workpiece paint roller assembly to be placed relative to the rollable paint bucket wherein the user may manipulate the elongated workpiece handle of the workpiece paint roller assembly to easily move the rollable paint bucket about on the generally flat surface during the painting procedure; and (d) said positioning means including a paint roller resting area having a positioning shelf attached interiorly to said wall section at a height intermediate said base and said upper extent, said positioning shelf including a roller resting surface that is positioned interiorly of said wall section and completely within said containment area of said body, said positioning shelf being engageable by the paint roller of the paint roller assembly such that the paint roller at least partially contacts said paint roller resting surface within said containment area and the user may manipulate the elongated handle of the paint roller assembly to move and guide the rollable paint bucket along the generally flat surface during the painting procedure, said containment area including a drainage area adjacent and below said roller resting surface to provide for at least a portion of a workpiece paint deposited in said paint roller resting area from the workpiece paint roller to drain into said containment area of said body.

2. A rollable paint bucket to retain paint during a painting procedure performed with a paint roller assembly, the paint roller assembly having a paint roller, a paint roller retention assembly and an elongated handle, the paint roller retention assembly to provide for axial rotation of the paint roller, the elongated handle attached to the paint roller retention assembly to provide for significant spacing of the user from the paint roller during the painting procedure, the rollable paint bucket comprising:

a body having a containment area to provide for receiving and containing a quantity of paint, the containment area readily accessible for transfer of a portion of the paint contained in the containment area to the paint roller assembly during the painting procedure, said containment area being defined by a lower base that forms a lower extent, a wall section attached to and extending upwardly from said base and an upper extent at the top of said wall section;

a plurality of rolling members attached relative to said body of said bucket, said rolling members to provide for ready movement of said bucket over a generally flat surface during the painting procedure; and a paint roller resting area including a positioning shelf attached interiorly to said wall section at a height intermediate said base and said upper extent, said positioning shelf including a roller resting surface that is positioned interiorly of said wall section and completely within said containment area of said body, said positioning shelf engageable by the paint roller of the paint roller assembly such that the paint roller at least partially contacts said paint roller resting surface within said containment area and the user may manipulate the elongated handle of the paint roller assembly to move and guide the rollable paint bucket along the generally flat surface during the painting procedure.

3. The bucket of claim 2 further including a user accessible end where the user would routinely stand during use of the rollable paint bucket during the painting procedure and a forward end located opposite said user accessible end, said positioning shelf extending inwardly from said wall section into said containment area at said user accessible end of said bucket.

4. The rollable paint bucket of claim 3 further comprising a paint roller contact area positioned in its entirety on the body within said containment area and beneath said positioning shelf and said roller resting surface and located between said positioning shelf and said forward end of said bucket, said paint roller contact area for rolling the paint roller along said paint roller contact area to distribute a desired quantity of paint from said containment area of said bucket onto the paint roller.

5. The rollable paint bucket of claim 4 wherein said paint roller contact area further comprises a lower extent and an upper extent and wherein said paint roller contact area has a generally planar surface having an orientation plane which is significantly offset relative to vertical and wherein said orientation plane of said generally planar surface of said paint roller contact area is sloped toward said user accessible end from said lower extent to said upper extent of said paint roller contact area.

6. The rollable paint bucket of claim 2 wherein said body further comprises a plurality of rolling member attachment positions and wherein each of said rolling members is detachably detachable to a respective rolling member attachment position.

7. The reliable paint bucket of claim 3 further comprising a pivotal handle secured relative to said body, said pivotal handle being displaceable within a range of motion between a resting position and a pouring position, said resting position to provide for the rollable paint bucket to be utilized during the painting procedure without undue interference by said pivotal handle, said pouring position to provide for said pivotal handle to be utilized by the user to provide for manipulation of the rollable paint bucket during removal of the paint from the containment area of the bucket.

8. The rollable paint bucket of claim 7 wherein said body further comprises a pouring area in said forward end of said bucket to provide for ready pouring of paint from the containment area.

9. The rollable paint bucket of claim 2 wherein said containment area of said body further comprises a first planar sloped base surface and a second planar sloped base surface with a linear juncture therebetween positioned at a lowest extent of said containment area, said lowest extent linear junction of said containment area to provide for a gathering of paint in an accessible area of said containment area for full utilization of the paint during the painting procedure.

10. The rollable paint bucket of claim 2 in which said positioning shelf is attached to said wall section at an elevational height that is above the elevational height within said containment area to which paint is routinely filled for use during the painting procedure.

11. The rollable paint bucket of claim 2 in which said paint roller resting area is positioned at an elevational height within said containment area that is above the elevational height of paint contained in said containment area and below said upper extent of said containment area.

12. The rollable paint bucket of claim 2 in which said positioning shelf includes a receptacle for receiving the paint roller to facilitate manipulation of the paint roller assembly to move the bucket along the generally flat surface.

13. The bucket of claim 12 in which said receptacle includes a curved shape that generally conforms to the circumferential shape of the paint roller.

14. The rollable paint bucket of claim 2 in which said wall section includes forward and rearward extents that are respectively positioned forwardly and rearwardly of said roller resting surface and wherein said lower base extends between said forward and rearward extents of said containment area and rearwardly of said roller resting shelf.

15. The rollable paint bucket of claim 2 in which said containment area includes a drainage area adjacent and below said roller resting surface to provide for at least a portion of workpiece paint deposited in said paint roller resting area from the workpiece paint roller to drain into said containment area of said body.

16. The rollable paint bucket of claim 15 in which said wall section includes forward and rearward extents that are respectively positioned forwardly and rearwardly of said roller resting surface and wherein said lower base extends between said forward and rearward extents of said containment area and rearwardly of said paint roller resting shelf.

17. A rollable paint bucket to retain paint during a painting procedure performed with a paint roller assembly, the paint roller assembly having a paint roller, a paint roller retention assembly and an elongated handle, the paint roller retention assembly to provide for axial rotation of the paint roller, the elongated handle attached to the paint roller retention assembly to provide for significant spacing of the user from the paint roller during the painting procedure, the rollable paint bucket comprising:

a body having a containment area to provide for receiving and containing a quantity of paint, the containment area readily accessible for transfer of a portion of the paint contained in the containment area to the paint roller assembly during the painting procedure, said containment area being defined by a lower base, a wall section attached to and extending upwardly from said base and an upper extent at the top of said wall section;

a plurality of rolling members attached relative to said body of said bucket, said rolling members to provide for ready movement of said bucket over a generally flat surface during the painting procedure; and a paint roller resting area including a positioning shelf attached interiorly to said wall section at a height intermediate said base and said upper extent, said positioning shelf including a roller resting surface that is positioned interiorly of said wall section and completely within said containment area of said body, said containment area including a drainage area adjacent and below said roller resting surface to provide for at least a portion of workpiece paint deposited in said paint roller resting area from the paint roller to drain into the containment area of the body, said positioning shelf engageable by the paint roller of the paint roller assembly such that the paint roller at least partially contacts said paint roller resting surface within said containment area and the user may manipulate the elongated handle of the paint roller assembly to move and guide the rollable paint bucket along the generally flat surface during the painting procedure.

18. The rollable paint bucket of claim 17 in which said wall section includes forward and rearward extents that are respectively positioned forwardly and rearwardly of said roller resting surface and wherein said lower base extends between said forward and rearward extents of said containment area and rearwardly of said paint roller resting shelf.

19. The rollable paint bucket of claim 17 further comprising a paint roller contact area positioned in its entirety on the body within said containment area and beneath said positioning shelf and said roller resting surface and located between said positioning shelf and said forward end of said bucket, said paint roller contact area for rolling the paint roller along said paint roller contact area to distribute a desired quantity of paint from said containment area of said bucket onto the paint roller.

* * * * *